US005161461A

United States Patent [19]

Purvis

[11] Patent Number: 5,161,461

[45] Date of Patent: Nov. 10, 1992

[54] VISUALLY FUNCTIONAL SAFETY COVERING DEVICE

[76] Inventor: Sandy A. Purvis, 6612 Charolais Dr., Lakeland, Fla. 33809

[21] Appl. No.: 580,189

[22] Filed: Sep. 10, 1990

[51] Int. Cl.[5] ..... B41L 25/02

[52] U.S. Cl. ..... 101/148; 101/350

[58] Field of Search ..... 101/147, 148, 479, 480, 101/349, 350, 351, 207, 208, 209, 210; 400/690.4, 690.1; 100/53

[56] References Cited

U.S. PATENT DOCUMENTS 3,286,622 11/1966 Mestre ..... 101/218
3,308,919 5/1965 Cunningham et al. ..... 400/690.4
3,404,625 10/1968 White ..... 101/148
3,557,817 1/1971 Royse ..... 101/148
4,463,674 8/1984 Becker et al. ..... 101/148
4,854,233 8/1989 Despot et al. ..... 100/53

*Primary Examiner*—Edgar S. Burr
*Assistant Examiner*—John S. Hilten
*Attorney, Agent, or Firm*—George A. Bode

[57] ABSTRACT

A design of dampening system safety cover comprising sustantial, transparent materials and the construction possibly utilizing a singular body design, along with a deliberate manner of extending and angling certain members to enhance safety, while still permitting adaptation of the new cover to the existing dampening system by employing existing hardware, providing both complete visual access, and operant isolation from the functional contents of the system.

7 Claims, 2 Drawing Sheets

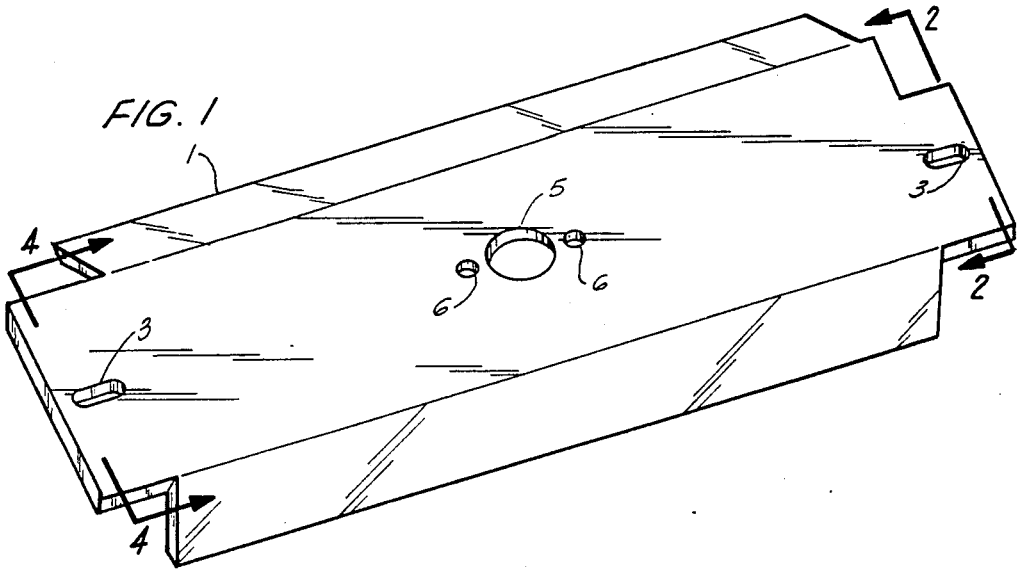
FIG. 1
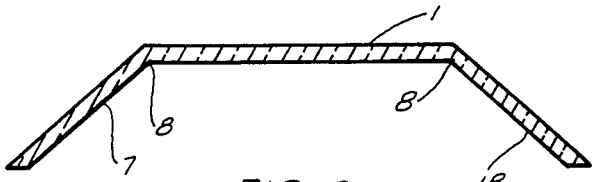
FIG. 2
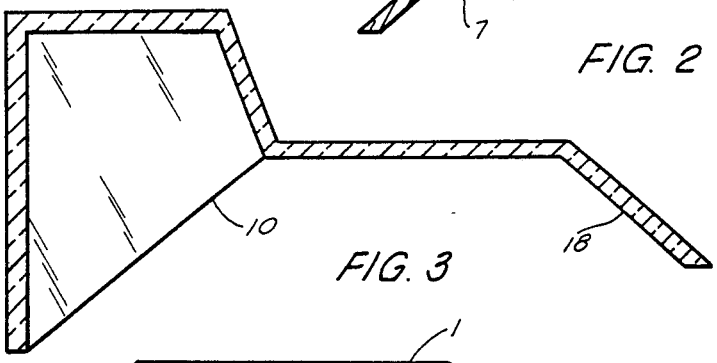
FIG. 3
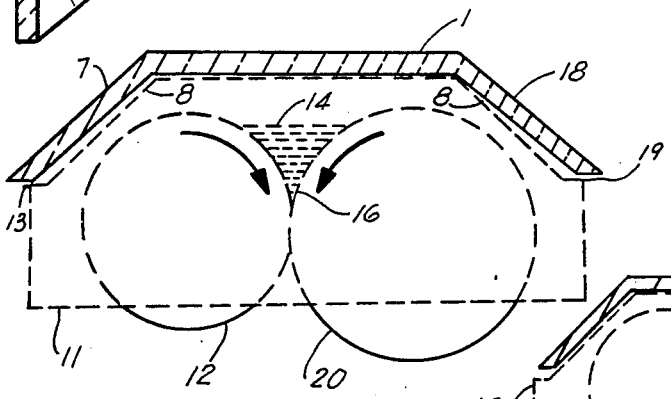
FIG. 4
FIG. 5
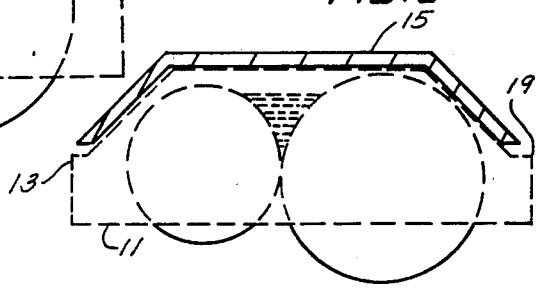

VISUALLY FUNCTIONAL SAFETY COVERING DEVICE

CROSS REFERENCE TO RELATED APPLICATIONS

VARN KOMPAC AUTOMATIC DAMPENING SYSTEM
GRAPH TECH INC. OAKLAND, N.J. U.S.A.
U.S. Pat. No. 4,455,938

BACKGROUND OF THE INVENTION

1. Field of the Invention

This invention relates to the current metalic device used to cover the dampening system in the above stated patent.

2. Description of Prior Art

The current method of covering the dampening system is by a metal device, which does not allow the operant of the system the capability to monitor the contents of the system. Many times the operator is not aware that the system is about to malfunction because they do not have visual contact with the contents of said system. Thus, when moisture is not present within the system during operation, toning of the printed sheets will occur which causes loss of productivity and as important, un-needed loss of a valuable natural resource, paper. When a problem such as this would occur too frequently, the operant would very likly remove the covering device for observation purposes, thus introducing a potential for injury. This invention eliminates these problems.

SUMMARY OF THE INVENTION

The invention is an improved design of dampening system covering device which affords the operant both safety and constant visual access to the contents of the system. The improved structure comprises a non-metalic configuration of construction, with a means to utilize overlapping members enabling visual inspection and added safety, achieving a true synergistic result.

It is an object of this invention to provide an inexpensive device that allows complete visual access of the system during operation.

Another object of this invention is to provide additional safety means by not requiring removal of said covering devise in order to observe contents of above stated system, along with the improved angled member configuration. This in itself will drastically reduce operator injuries related to this style dampening system.

Another object of this invention, directly related to it's visual functionability, is to afford further means of inventiveness in the area of a reliable moisture supply system in which there is a long felt and yet unsolved need.

Another object of this invention is to reduce costly down-time associated with toning of sheets and paper jams caused by absence of moisture in the unit.

Another object of this invention is to drastically reduce the loss of our valued natural resource, paper.

Another object of this invention is to reduce the amount of operant stress associated with the above stated situations.

Another object of this invention is to improve operant productivity due to the lack of the above stated problems.

BRIEF DESCRIPTION OF THE DRAWINGS

Other objects and purposes of my invention will become apparent to persons familiar with this type of equipment upon referring to the accompanying illustrations in which:

FIG. 1 is a perspective view of this invention.

FIG. 2 is a sectional view of this invention taken along line 2 of FIG. 1.

FIG. 3 is a sectional view of an alternate spieces of this invention relating directly to another model of this dampening system.

FIG. 4 is a sectional view of this invention taken along line 4 of FIG. 1, shown installed on the related dampening system.

FIG. 5 is a sectional view of prior art, shown installed on the same related dampening system.

DESCRIPTION OF THE PREFERRED EMBODIMENTS

Figure 6:
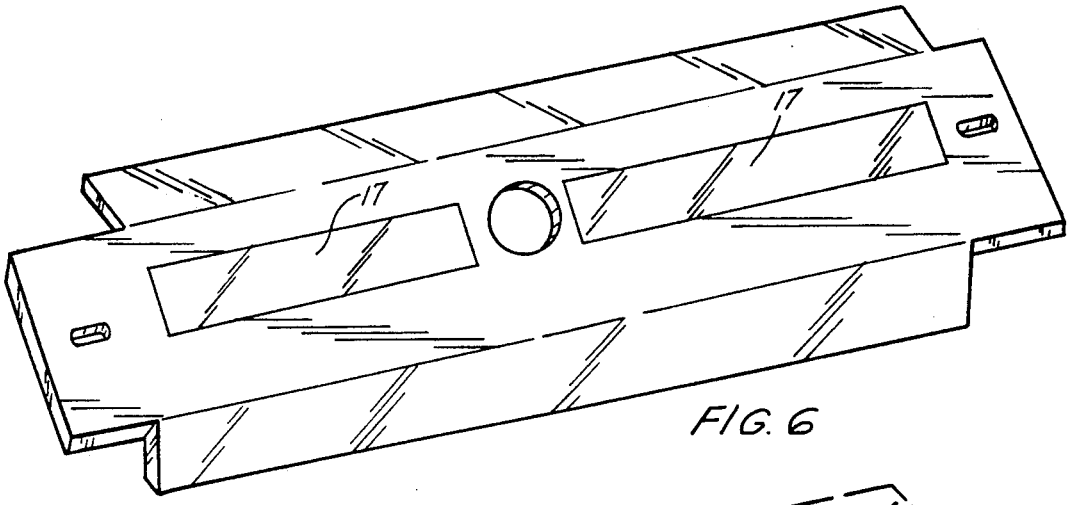
FIG. 6 is a perspective view of an alternate spieces of this invention.

For the purposes imposed by this inventor only, and not imposing any limitations whatsoever on the construction of this new and improved covering device, the material utilized in the construction for the reasons of transparency, strength, and durability was a very substantial composition called Lexan. For the purpose of simplicity, I will refer to this device as the "new cover".

Referring to FIG. 1, numeral 1 is an embodiment of the invention shown in an unattached manner. In this embodiment, the invention contemplates a particular singular body design of cover, allowing total adaptability and securement to the existing dampening system by means of openings 3 allowing securement to the existing dampening device and opening 5 allowing attachment of existing cover nozzle with said nozzle being of a gravitational design and attached by existing hardware utilizing openings 6.

The embodiment in FIG. 2, is a sectional view of FIG. 1, numeral 1 showing the deliberately angled members 7 & 18, formed at 40 degrees 8 relative to the top surface of the cover 1 allowing the angled members 7 & 18 to be lengthened to overlap the existing side frames of the dampening device, insuring added safety.

The embodiment in FIG. 3 shows a sectional view of a alternate spieces configuration, adapted to be secured in the same manner as the embodiment in FIG. 1. This embodiment also utilizes a single 40 degree member 18 for overlapping, incorporated with end-covering members 10 attached to the extended compartment that accommodates an oscillating roll attachment for the dampening system, still allowing complete security and visability in relationship to internal components.

The embodiment in FIG. 4 is the same sectional view of FIG. 1 numeral 1, showing in more detail, the new cover 1 mechanically attached to the existing dampening system 11, thus, showing the direct relationship between the dampener rolls 12 & 20, with a dangerous inward nip 16 shown by a circular rotation in the direction of the arrows, the side frames 13 & 19 and the moisture content 14. Also the utilization of 40 degree bends 8 allowing for extended side members 7 & 18 to overlap the existing system side frames 13 & 19 allowing complete operant isolation for added safety.

Illustrated in FIG. 5, is a sectional view of the existing cover, depicting the deficiencies existing in the prior art as a matter of fact and easily recognized. The relationship of the metal cover 15 to dampening system 11 and side frames 13 & 19 is as a somewhat protective means only, with no means for the visual contact afforded by this invention.

FIG. 6 is a prospective view of an additional spieces of the invention utilizing a metalic composition with the means for visual inspection comprised of any transparent material 17 adapted to be secured to the cover in a manner allowing visability in regards to the contents of the system.

Figure 7:
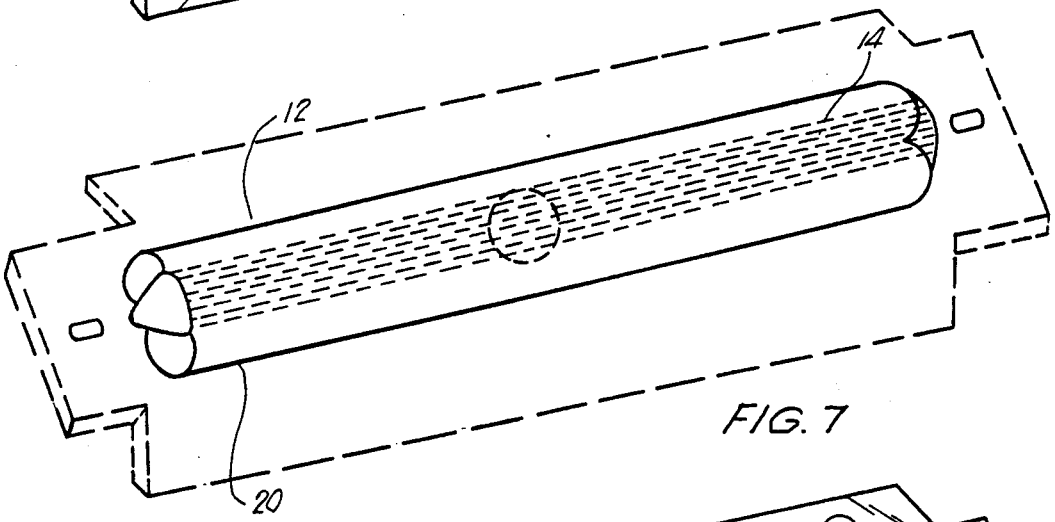
FIG. 7 is a perspective view of this invention showing the functional contents of the system afforded the operator with this invention installed.

FIG. 7 illustrates the visual benefits derived from this invention in direct relationship to the contents of the dampening device, these contents being the dampening rolls 12 & 20, along with the limited amount of moisture 14 supplied by a remote supply system. Since there are no remote moisture supply systems that can be relied upon to feed moisture in a consistant manner to this dampening system, this invention would allow the visability needed, without jeopardizing safety, to develop a supply system that is reliable. This could be accomplished by anyone with general knowledge of the product, due in fact to the safe visability afforded with the new cover. The moisture supply systems in existance cannot function with the cover removed since the nozzle mentioned in the reference to FIG. 1 is of a gravitational design and must be positioned in the moisture content to function. Design improvements to the supply system now could be directly monitored and easily captured.

Figure 8:
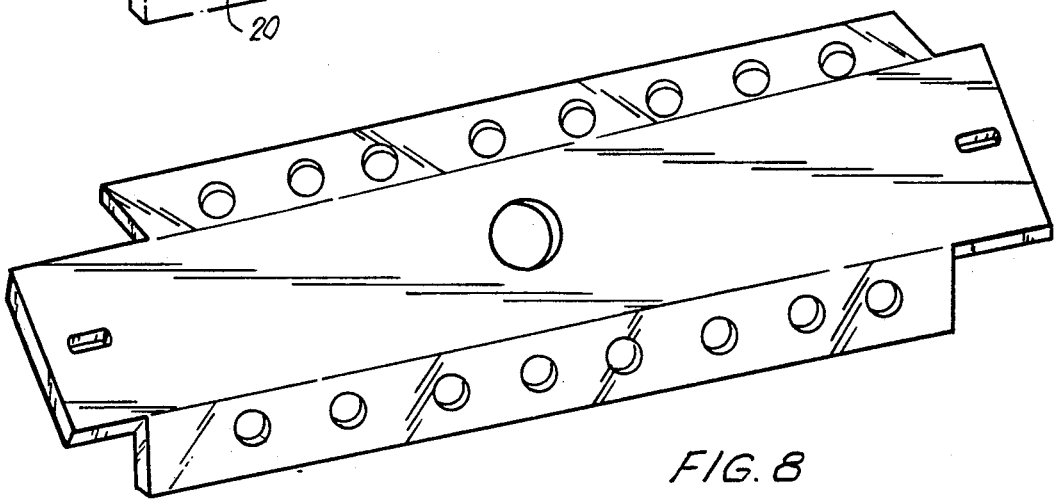
FIG. 8 is a perspective view of prior art which does not afford the operator visual access to the contents of the above stated system.

FIG. 8 shows the existing cover in perspective with the lack of any real means to eliminate this long felt yet unresolved deficiency related to both the current lack of visability to the dampening system and the unreliable remote supply system by anyone other than the manufacturer of the system. This is due to the fact that the cover must be removed during operation to determine the level of moisture present in the system.

The disclosure of this invention described above represents the preferred embodiments; however, variations thereof, in the construction, form or arrangement of the various components or application of the invention are possible without departing from the spirit and scope of the invention.

Having thus described the invention, what is claimed and desired secured by Letters Patent is:

1. A shield for a dampening system water unit of a printing press, said shield being removably adapted to said dampening system wherein the improvement comprises: means for constant visual monitoring of said dampening device having a centrally positioned aperture therein, whereby said means comprise materials offering little impediment to vision therethrough; and, means for operant isolation from internal components of said dampening system, said shield having a flat top member and side members, said side members integrally depending downwardly from said top member at opposite marginal edges thereof, said top member having therein said central aperture and transversely elongated apertures on opposing sides of said central aperture.

2. A shield for a dampening system unit of a printing press, said dampening system having side frames, and said shield being removably securable to said dampening system and comprising;

(a) a flat, elongated, substantially rectangular top member having a centrally located circular aperture therein for accepting a nozzle of a source of moisture and a pair of elongated substantially rectangular apertures therein, said elongated apertures being provided on opposing sides of said centrally located aperture, said elongated apertures being filled with a transparent member;

(b) a pair of elongated side members integrally formed with and downwardly depending from opposing marginal side edges of said top member at an acute angle to the horizontal, whereby said side members overlap the side frames of said dampening system, said side members being of a longitudinal dimension less than said top member, thereby forming a notch at each of the corners of said shield; and, (c) means for securing said shield to said dampening system.

3. The shield of claim 2, wherein said top member and side members are of an opaque metal material.

4. The shield of claim 2, wherein said acute angle is approximately forty (40°) degrees.

5. A shield for a dampening system unit of a printing press, said dampening system having side frames, and said shield being removably securable to said dampening system and comprising:

(a) a flat, elongated, substantially rectangular top member having a centrally located circular aperture therein for accepting a nozzle of a source of moisture;

(b) a first elongated side member integrally formed with and downwardly depending from a first marginal side edge of said top member to a terminus at an acute angle to the horizontal, whereby said side member overlaps the side frames of said dampening system, said side member being of a longitudinal dimension less than said top member, thereby forming a notch at the corners formed by said top member and said first side member;

(c) a second elongated side member integrally formed at its first marginal side edge with an upwardly depending from a second marginal side edge of said top member at an obtuse angle to the horizontal, said first and second marginal side edges of said top member being opposing edges;

(d) an elongated, substantially rectangular, horizontal arm member integrally formed at its first marginal side edge with said second side member and horizontally depending from a second marginal side edge of said second side member, said marginal side edge being opposite the first marginal side edge of said second side member;

(e) a third elongated side member integrally formed with and downwardly depending from a second marginal side edge of said horizontal arm member, said first and second marginal side edges of said horizontal arm member being opposing edges opposite, said third side member having its terminus at a point at or below said terminus of said first side member, said second and third side members and said horizontal arm defining a side compartment of said shield; and, (f) means for securing said shield to said dampening system.

6. The shield of claim 5, wherein said shield is of a transparent material.

7. The shield of claim 5, wherein said acute angle is approximately forty (40°) degrees.

* * * * *